US005830041A

United States Patent [19]

Takahashi et al.

[11] Patent Number: 5,830,041

[45] Date of Patent: Nov. 3, 1998

[54] METHOD AND APPARATUS FOR DETERMINING ENDPOINT DURING A POLISHING PROCESS

[75] Inventors: Tamami Takahashi, Yamato; Fumihiko Sakata, Yokohama; Norio Kimura, Fujisawa; Masako Kodera, Yokohama; Atsushi Shigeta, Fujisawa, all of Japan

[73] Assignee: Ebara Corporation, Tokyo, Japan

[21] Appl. No.: 743,361

[22] Filed: Nov. 4, 1996

[30] Foreign Application Priority Data

Nov. 2, 1995 [JP] Japan ..... 7-309982

[51] Int. Cl.[6] ..... B24B 7/22

[52] U.S. Cl. ..... 451/8; 451/41

[58] Field of Search ..... 451/41, 8, 10, 451/11, 28; 156/626.1; 437/7; 438/692, 693

[56] References Cited

U.S. PATENT DOCUMENTS

| | | | |
|---|---|---|---|
| 4,910,155 | 3/1990 | Cote et al. | 437/8 |
| 5,036,015 | 7/1991 | Sandhu et al. | 437/8 |
| 5,069,002 | 12/1991 | Sandhu et al. | 451/1 |
| 5,222,329 | 6/1993 | Yu | 451/11 |
| 5,245,794 | 9/1993 | Salugsugan | 451/8 |
| 5,308,438 | 5/1994 | Cote et al. | 156/636 |
| 5,439,551 | 8/1995 | Meilke et al. | 156/626.1 |
| 5,668,063 | 9/1997 | Fry et al. | 438/692 |

FOREIGN PATENT DOCUMENTS

| | | |
|---|---|---|
| 0 616 362 | 9/1994 | European Pat. Off. . |
| 2 275 130 | 8/1994 | United Kingdom . |

OTHER PUBLICATIONS

J.D. Warnock, "End Point Detector For Chemi–Mechanical Polisher", IBM Technical Disclosure Bulletin, vol. 31, No. 4, pp. 325–326, IBM Corp., Sep. 1988.

U.S. Patent Application Ser. No. 08/588,241, filed Jan. 18, 1996, entitled "Polishing Endpoint Detection Method", by Norio Kimura et al.

*Primary Examiner*—Robert A. Rose
*Attorney, Agent, or Firm*—Wenderoth, Lind & Ponack, LLP

[57] ABSTRACT

A method and apparatus for determining a planar end point on a workpiece such as a semiconductor wafer in a polishing process for polishing the workpiece to a flat mirror finish. The workpiece having an uneven surface is held by a top ring and pressed against a polishing platen. The workpiece is moved relative to the polishing platen to polish the workpiece, and a change in a frictional force between the workpiece and the polishing platen is detected. A reference time when the workpiece having an uneven surface is polished to a flat surface is determined based on the change of the frictional force between the workpiece and the polishing platen. The time when a certain period of polishing time from the reference time elapses is determined as an endpoint on the workpiece.

10 Claims, 3 Drawing Sheets

METHOD AND APPARATUS FOR DETERMINING ENDPOINT DURING A POLISHING PROCESS

BACKGROUND OF THE INVENTION

1. Field of the Invention

The present invention relates to a method and apparatus for determining an endpoint in a polishing process, and more particularly to a method and apparatus for determining a planar endpoint of a workpiece such as a semiconductor wafer during a polishing process of polishing the workpiece to a flat mirror finish.

2. Description of the Related Art

Recent rapid progress in semiconductor device integration demands smaller and smaller wiring patterns or interconnections and also narrower spaces between interconnections which connect active areas. One of the processes available for forming such interconnections is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus.

Conventionally, a polishing apparatus has a turntable and a top ring which rotate at respective individual speeds. A polishing cloth is attached to the upper surface of the turntable. A semiconductor wafer to be polished is placed on the polishing cloth and clamped between the top ring and the turntable. An abrasive liquid containing abrasive grains is supplied onto the polishing cloth and retained on the polishing cloth. During a polishing process, the top ring exerts a certain pressure on the turntable, and the surface of the semiconductor wafer held against the polishing cloth is therefore polished to a flat mirror finish while the top ring and the turntable are rotating.

After the semiconductor wafer having an uneven or irregular surface is polished to a flat surface, the polishing process should be stopped at a desired timing, i.e. a time which will result in a desired surface height of the semiconductor wafer. However, the timing when the polishing process is terminated cannot be easily determined for the following reasons:

(1) In the polishing apparatus described above, since the entire surface to be polished of the semiconductor wafer is in sliding contact with the polishing cloth, the surface which is being polished is not exposed outwardly.

(2) The semiconductor wafer is wet with the abrasive liquid supplied thereto during the polishing process.

(3) Recent polishing technique requires a surface finishing on the order of angstroms (Å), but there are extremely limited techniques available for accurately measuring this high level of surface finishing.

(4) A required endpoint, for a particular semiconductor wafer depends on the type of the semiconductor wafer.

Therefore, there has been a demand for techniques which can accurately determine an endpoint for a semiconductor wafer in the polishing process.

SUMMARY OF THE INVENTION

It is therefore an object of the present invention to provide a method and apparatus for determining an endpoint in a polishing process for polishing a workpiece such as a semiconductor wafer having an uneven surface to a flat mirror finish, which can determine an endpoint for the workpiece at a desired timing or point.

According to a first aspect of the present invention, there is provided a method of determining an endpoint in a polishing process of a workpiece, comprising the steps of: holding a workpiece having an uneven surface by a holding member and pressing the workpiece against a polishing platen; moving the workpiece relative to the polishing platen to polish the workpiece; detecting a change in a frictional force between the workpiece and the polishing platen; determining a reference time when the workpiece having an uneven surface is polished to a flat surface based on the change in the frictional force between the workpiece and the polishing platen; and determining the time when a certain period of polishing time from the reference time elapses as an endpoint on the workpiece.

According to a second aspect of the present invention, there is provided an apparatus for determining an endpoint in a polishing process of a workpiece, comprising: a polishing platen; a top ring for holding a workpiece having an uneven surface and pressing the workpiece against the polishing platen; a driving mechanism for moving the workpiece relative to the polishing platen; a detector for detecting a change in a frictional force between the workpiece and the polishing platen; a processing device for determining a reference time when the workpiece having an uneven surface is polished to a flat surface based on the change in the frictional force between the workpiece and the polishing platen, and for determining the time when a certain period of polishing time from the reference time elapses as an endpoint on the workpiece.

According to the present invention, inasmuch as the time when the workpiece having an uneven or irregular surface is polished to a flat surface can be detected on the basis of a change in a frictional force between the workpiece and the polishing platen, an endpoint for the workpiece can be determined on a real-time basis during polishing. Since a certain period of polishing time is set from a reference time when the workpiece having an uneven surface is polished to a flat surface, the endpoint for the workpiece can be determined at a desired point, and thus this method can meet a demand for determining various endpoints.

Since a change in a frictional force can be detected by a change in current of a driving motor for a polishing platen or a holding member such as a top ring, a small change in the frictional force can be detected. Further, since the polishing time from the time when an uneven surface of the workpiece is changed into a flat surface can be corrected in succession on the basis of data obtained from previous polishing operations, it is possible to comply with a change in a polishing rate with time.

The above and other objects, features, and advantages of the present invention will become apparent from the following description when taken in conjunction with the accompanying drawings which illustrate preferred embodiments of the present invention by way of example.

DESCRIPTION OF THE PREFERRED EMBODIMENTS

A method and apparatus for determining an endpoint in a polishing process according to an embodiment of the present invention will be described below with reference to the drawings.

Figure 1:
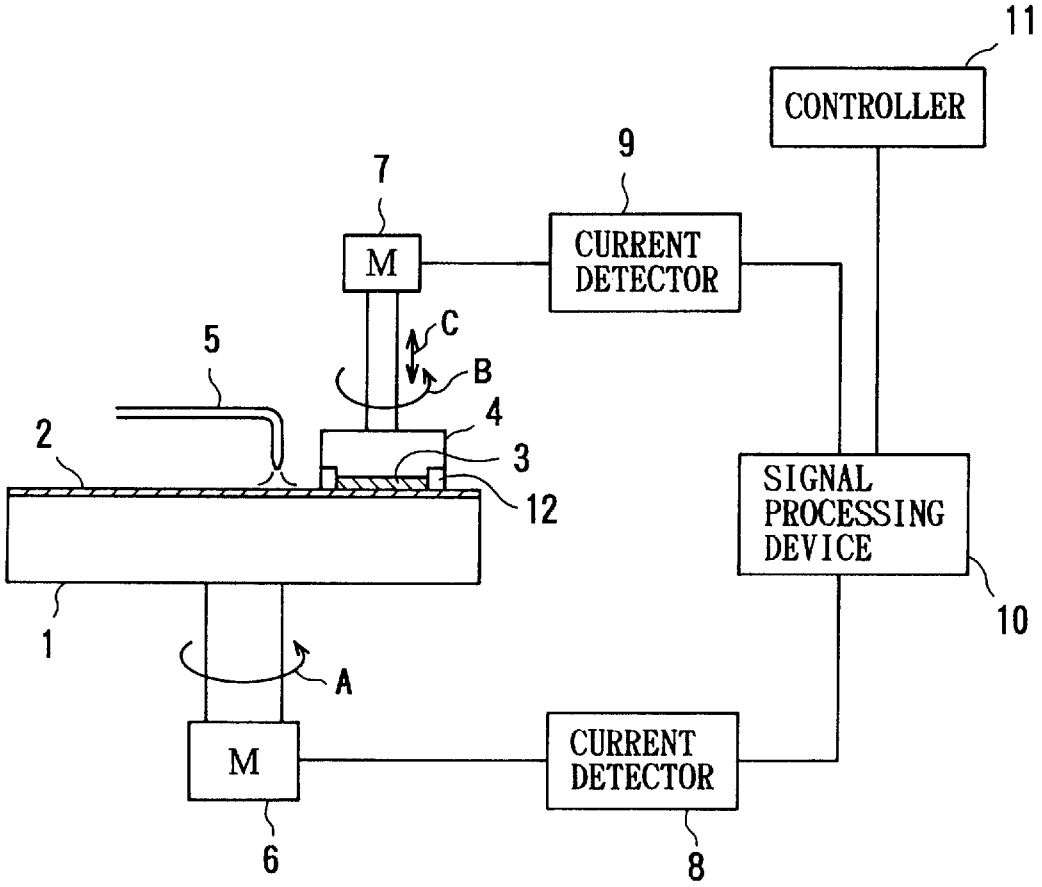
FIG. 1 is a schematic front view showing a polishing apparatus having an endpoint detection device of the present invention.

FIG. 1 is a schematic front view showing a polishing apparatus having an endpoint detection device according to the present invention. The polishing apparatus comprises a turntable 1, a polishing cloth 2 attached to an upper surface of the turntable 1, and a top ring 4 for holding a semiconductor wafer 3 and pressing the semiconductor wafer 3 against the polishing cloth 2. The polishing cloth 2 constitutes a polishing platen which contacts the semiconductor wafer 3. The turntable 1 is rotatable about its own axis as indicated by the arrow A by a first motor 6 which is coupled to the turntable 1. The top ring 4 is coupled to a second motor 7 and also to a lifting/lowering cylinder (not shown). The top ring 4 is rotatable about its own axis and is vertically movable as indicated by the arrows B, C by the second motor 7 and the lifting/lowering cylinder.

The polishing apparatus further includes a first motor current detector 8 connected to the first motor 6 which rotates the turntable 1, a second motor current detector 9 connected to the second motor 7 which rotates the top ring 4, and a signal processing device 10 connected to the first and second current detectors 8 and 9 for determining an endpoint in a polishing process. The signal processing device 10 is connected to a controller 11 which controls the overall operation of the polishing apparatus.

The top ring 4 which holds a semiconductor wafer 3, with a surface to be polished facing downward, presses the semiconductor wafer 3 against the polishing cloth 2 under a desired pressure. The semiconductor wafer 3 is attached to a lower surface of the top ring 4 under a vacuum or the like. A guide ring 12 is mounted on the outer circumferential edge of the lower surface of the top ring 4 for preventing the semiconductor wafer 3 from being disengaged from the top ring 4. An abrasive liquid supply nozzle 5 is disposed above the turntable 1 for supplying an abrasive liquid onto the polishing cloth 2 attached to the turntable 1.

The polishing apparatus operates as follows: The semiconductor wafer 3 is held on the lower surface of the top ring 4, and pressed against the polishing cloth 2 on the upper surface of the turntable 1. The turntable 1 and the top ring 4 are rotated relative to each other for thereby bringing the lower surface of the semiconductor wafer 3 into sliding contact with the polishing cloth 2. At this time, the abrasive liquid nozzle 5 supplies the abrasive liquid to the polishing cloth 2. The lower surface of the semiconductor wafer 3 is now polished by a combination of a mechanical polishing action of abrasive grains in the abrasive liquid and a chemical polishing action of a chemical solution such as an alkaline solution in the abrasive liquid.

Figure 2B:
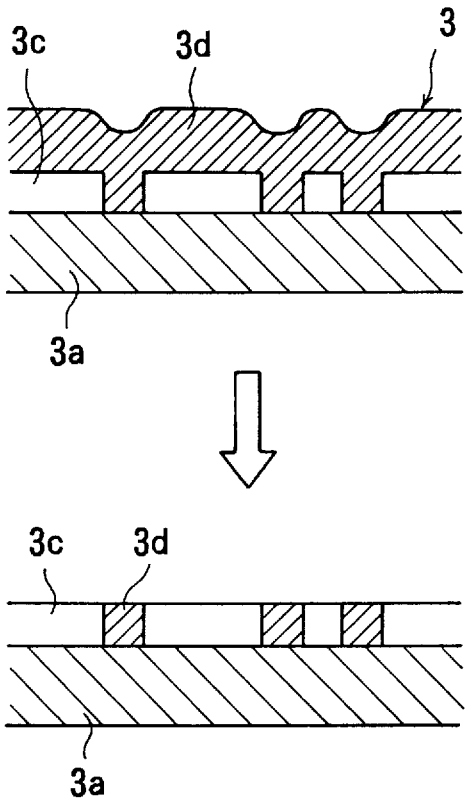
FIG. 2B is an enlarged cross-sectional view showing another example of a semiconductor wafer before and after a polishing process.
Figure 2A:
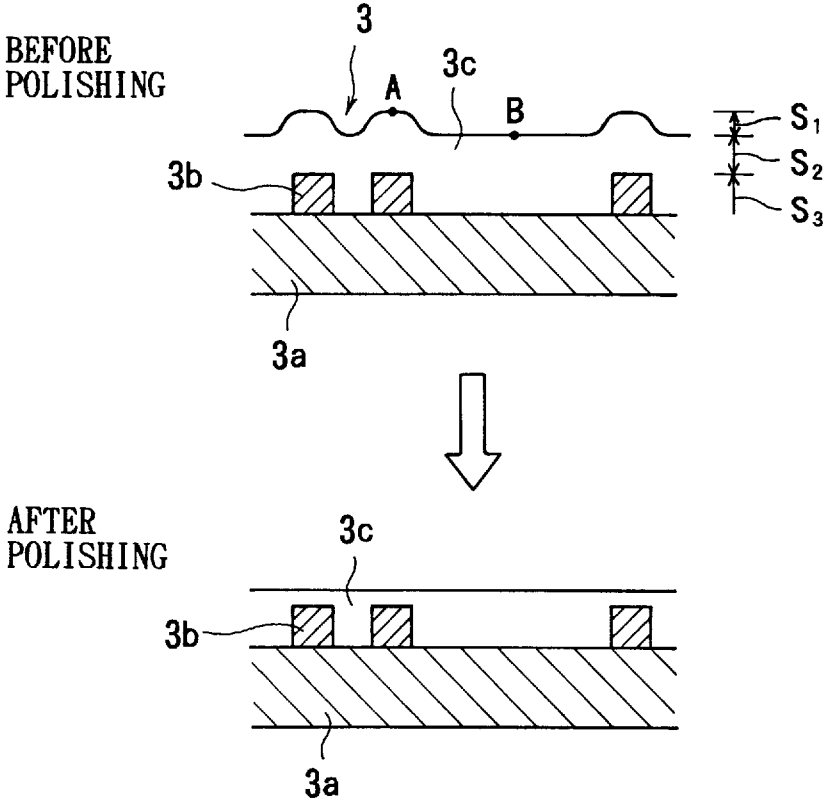
FIG. 2A is an enlarged cross-sectional view showing one example of a semiconductor wafer before and after a polishing process.

FIG. 2A is a cross-sectional view showing one example of a semiconductor wafer before and after a polishing process. As shown in FIG. 2A, the semiconductor wafer 3 comprises a silicon substrate (Si) 3*a*, metal wiring patterns or wiring pattern portions 3*b* formed on the silicon substrate 3*a*, and an insulating layer 3*c* made of silicon dioxide ($SiO_2$) which covers the metal wiring patterns 3*b* and the silicon substrate 3*a*. The silicon substrate 3*a* has a flat surface, but formation of the metal wiring patterns 3*b* makes the surface of the wafer 3 uneven. Thus, the insulating layer 3*c* formed on the metal wiring patterns 3*b* and the silicon substrate 3*a* has an uneven upper surface.

Recent higher integration in semiconductor devices demands smaller wiring patterns and more multilayer construction, and hence a more and more planarized finish of the semiconductor wafer. In order to meet higher integration demands, an ultraviolet ray having a shorter wavelength, such as a g-beam or an i-beam, is used in photolithography. When the light having a shorter wavelength is used in photolithography, an allowable difference of elevation on the surface of the semiconductor wafer is small because the depth of focus of the optical system is relatively small. Thus, a high degree of flatness of the semiconductor wafer is required at a focal point of the ultraviolet ray.

As described above, one customary way of flattening an uneven surface of the semiconductor wafer is to polish it with the polishing apparatus. In a polishing process, after a certain period of polishing time, the polishing process is required to be stopped at a desired timing. In other words, it is desirable that the polishing process is terminated at a desired surface height of the semiconductor wafer after a certain period of polishing time. In some cases, the insulating layer 3*c* having a certain thickness must be left on the metal wiring patterns 3*b* as shown in FIG. 2A. In the upper part of FIG. 2A, the semiconductor wafer 3 before the polishing process is illustrated, and in the lower part of FIG. 2A, the semiconductor wafer 3 after the polishing process is illustrated. In the case where after the polishing process, another layer such as a metallic layer is formed on the insulating layer 3*c*, the insulating layer 3*c* is called an interlayer insulator. In this case, when the insulating layer 3*c* is excessively polished, the metal wiring patterns 3*b* will be exposed. Therefore, the polishing process must be terminated so as to leave the insulating layer 3*c* having a certain thickness on the metal wiring patterns 3*b*, which is to be an interlayer insulator.

Next, a method and apparatus which fulfills the foregoing demand will be described.

Figure 3:
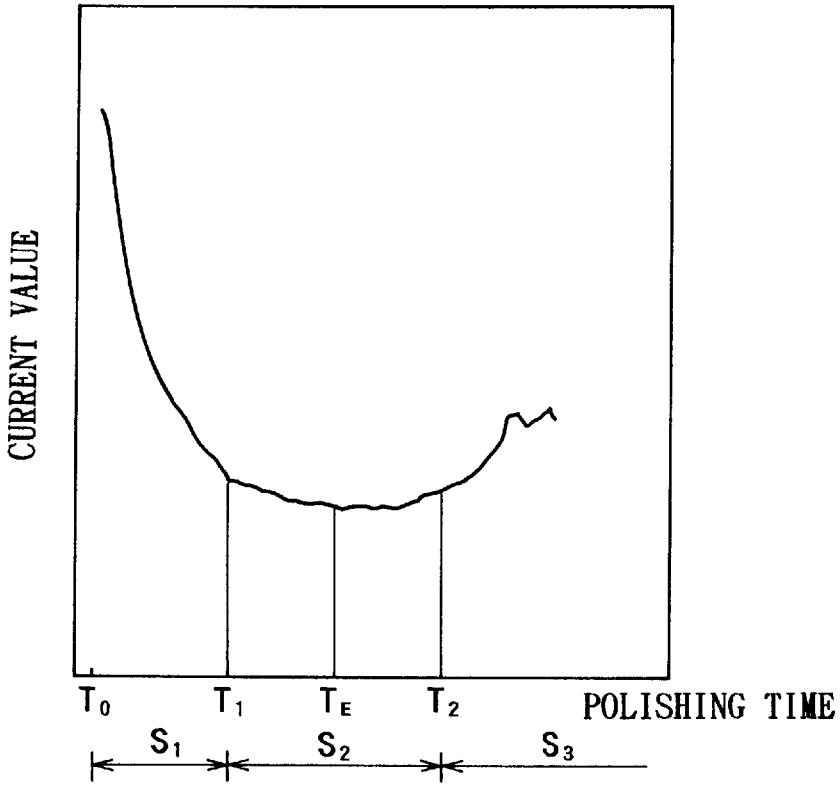
FIG. 3 is a graph showing a change in a frictional force between a semiconductor wafer and a polishing cloth during the polishing process.

FIG. 3 is a graph showing the relationship between current value of the first motor 6 and the polishing time during a polishing process. The first motor 6 rotates the turntable 1. The current value of the first motor 6 is detected and processed in accordance with a predetermined signal processing by the first motor current detector 8 to thus obtain current value shown in FIG. 3. In FIG. 3, the horizontal axis represents the polishing time, and the vertical axis represents the current value of the first motor 6.

At a time T0, a polishing process of the semiconductor wafer 3 is started. A frictional force between the semiconductor wafer 3 and the polishing cloth 2 decreases as the polishing process progresses. At a time T1, the frictional force becomes relatively stable. This is because the semiconductor wafer 3 having an uneven surface is polished to a flat surface. Based on a change in the frictional force, the time T1 is regarded as a reference time when the uneven surface is polished to a flat surface. At this time, the difference of elevation on the surface of the semiconductor wafer 3 disappears, and the surface of the semiconductor wafer 3 which is being polished is shifted from the highest point A to the lowermost point B in FIG. 2A. The interlayer insulator 3*c* can be left by continuing polishing of the semiconductor wafer 3 for a certain period of time from the time T1 until the layer underneath the lowermost point B is exposed outwardly. The polishing time from the time T1 is obtained by dividing a desired amount of material removed from the semiconductor wafer after the flat surface is obtained, by an estimated polishing rate. In this case, the estimated polishing rate has been obtained from the polishing amount, i.e. the amount of material removed from the semiconductor wafer and the polishing time of the semiconductor wafer beforehand. To be more specific, the estimated polishing rate is determined based on a polishing amount and a polishing time of at least one semiconductor wafer which has been polished immediately before polishing the semiconductor wafer which is an object for which an endpoint is to be determined. The endpoint in the polishing process is determined so as to allow the interlayer to be left by setting the polishing time in the above manner. In one example of FIG. 3, the time TE within the time S2 between the time T1 and the time T2 is determined as an endpoint in the polishing process.

The electric current of the first motor 6 is detected by the first motor current detector 8, and the detected electric current signal is sent to the signal processing device 10. In the signal processing device 10, the electric current signal is processed to eliminate noise and further to determine the reference time when the uneven surface is polished to a flat surface, and the polishing time from the reference time is calculated on the basis of the polishing rate which has been input to the signal processing device 10. The signal processing device 10 sends an endpoint signal to the controller 11 when the calculated polishing time has elapsed, and the controller 11 stops the polishing process of the polishing apparatus.

The frictional force between the semiconductor wafer 3 and the polishing cloth 2 attached to the turntable 1 acts as a friction torque against the turntable 1. This means that a change in a frictional force can be measured as a change in a torque applied to the turntable 1. When the turntable is rotated by an electrical motor, a change in torque is indirectly measured as a change in electric current of the electric motor.

In the above description, although the electric current of the first motor 6 which rotates the turntable 1 is used for determining an endpoint in the polishing process, the electric current of the second motor 7 which rotates the top ring 4 may be also used for determining an endpoint in the polishing process. In this case, the electric current of the second motor 7 is detected by the second motor current detector 9, and is processed by the signal processing device 10.

Referring again to FIG. 3, after the time T2, the metal wiring patterns 3*b* (see FIG. 2A) are exposed outwardly, and a change in a frictional force increases during the polishing operation, as shown in FIG. 3. In FIG. 3, the time S1 corresponds to the time during which the uneven surface is polished, the time S2 corresponds to the time during which the flat surface is polished, and the time S3 corresponds to the time during which the layer including a different material is polished, each of which corresponds to the thicknesses S1, S2, S3 of the semiconductor wafer, respectively, in FIG. 2A.

It is known that the polishing rate generally changes with deterioration with age of the polishing cloth, and other unknown factors. If the polishing rate is set to be constant in determining the polishing time from the reference time when an uneven surface is polished to a flat surface, since a change in the polishing rate is not taken into consideration, the polishing amount will be insufficient or excessive. In order to avoid such an insufficient or excessive polishing, the polishing amount of the semiconductor wafer may be measured to correct the polishing rate, as required. The polishing amount is obtained as the difference between the thicknesses of the layer before and after polishing. Since the polishing rate of each semiconductor wafer usually varies, an average polishing rate of a plurality of semiconductor wafers which have been polished immediately before polishing the semiconductor wafer for which an endpoint is to be determined may be calculated. In order to correct the polishing rate automatically, the polishing apparatus may further include a measuring device for measuring the thickness of the polished layer. The measuring device may be connected to the signal processing device 10.

In the above description, although the polishing process is terminated so as to leave the interlayer, the semiconductor wafer may be polished until a lower layer underneath a top layer is exposed outwardly, as shown in FIG. 2B. In the upper part of FIG. 2B, the semiconductor wafer before the polishing process is illustrated, and in the lower part of FIG. 2B, the semiconductor wafer after the polishing process is illustrated. As shown in FIG. 2B, a semiconductor wafer 3 comprises a silicon substrate 3*a*, an insulating layer 3*c* made of silicon dioxide ($SiO_2$) formed on the silicon substrate 3*a*, and a metal layer 3*d* formed on the insulating layer 3*c*. The insulating layer 3*c* is partially removed to define grooves by etching. When the semiconductor wafer is polished up to an upper surface of the insulating layer 3*c*, the metal layer 3*d* remains only in grooves defined by the etching of the insulating layer 3*c*.

In this case also, the time when an uneven surface of the metal layer 3*d* is polished to a flat surface is determined by observing current of one of the first and second motors 6 and 7, and the determined time is regarded as a reference time. The time when a certain period of time from the reference time has elapsed is determined as an endpoint in the polishing process. The polishing time during which the polishing surface reaches the insulating layer 3*c* is calculated on the basis of the polishing rates which have been experienced ahead of time.

According to the method and apparatus for determining an endpoint in a polishing process of the present invention, since a reference time for setting a certain period of polishing time is the time when an uneven surface is polished to a flat surface, it is possible to comply with a demand for determining various endpoints including, for example, an endpoint for leaving the interlayer and an endpoint for the time when the polishing surface reaches the layer including a different material.

The frictional force at the time when an uneven surface is being polished is different from that at the time when a flat surface is being polished because of the difference in the coefficients of friction therebetween. The frictional force is expressed as the product of the coefficient of friction between the workpiece and the polishing cloth, and the pressing force by which the workpiece is pressed against the polishing cloth. The coefficient of friction depends on materials of the workpiece and the polishing cloth, and surface conditions of the workpiece and the polishing cloth. Even if workpieces are made of the same material, a workpiece having a rough surface has a larger coefficient of friction than a workpiece having a fine surface. The basic concept of the present invention utilizes a change in the coefficient of friction which occurs when an uneven or irregular surface of the workpiece is changed into a flat surface or when a rough surface of the workpiece is changed into a flat mirror surface.

As is apparent from the above description, the present invention offers the following advantages:

(1) Since the state of the polishing surface of the workpiece can be detected on a real-time basis based on the frictional force between the workpiece and the polishing platen, the endpoint can be determined while polishing is being performed.

(2) Since an endpoint on the workpiece can be set to a desired point or timing, this method can meet a demand for determining various endpoints depending on the type of the workpiece.

(3) Since a change in a frictional force can be detected by a change in current of a driving motor for a polishing platen or a holding member such as a top ring, a small change in the frictional force can be detected.

(4) Since the polishing time from the time when an uneven surface of the workpiece is changed into a flat surface can be corrected in succession on the basis of data obtained from the previous polishing operations, it is possible to comply with a change in polishing rate with time.

In the above embodiments, although the polishing time from the reference time to the endpoint is set to a certain period of time, this certain period of time may be in the range of substantially zero second to several minutes.

Although a certain preferred embodiment of the present invention has been shown and described in detail, it should be understood that various changes and modifications may be made thereto without departing from the scope of the appended claims.

What is claimed is:

1. A method of determining an endpoint of a process of polishing a semiconductor wafer including unexposed wiring pattern portions covered by an exposed insulating layer having an uneven exposed surface, said method comprising:

pressing said exposed uneven surface against a polishing platen while moving said semiconductor wafer and said platen relative to each other, thereby polishing said surface;

detecting a frictional force between said surface and said platen;

determining a reference time as a time of a change in the detected frictional force representative of said exposed uneven surface having been polished to a flat surface; and determining said endpoint as a certain period of time of continued polishing after said reference time at which a predetermined thickness portion of said exposed insulating layer remains covering said wiring pattern portions without said wiring pattern portions being exposed.

2. A method as claimed in claim 1, wherein said detecting comprises determining a change in current of a driving motor driving said platen or a holding member pressing said semiconductor wafer against said platen.

3. A method as claimed in claim 1, wherein said certain period of time is variable and is determined base don an amount of polishing and a polishing time of a least one other previously polished semiconductor wafer.

4. A method as claimed in claim 3, wherein said at least one other previously polished semiconductor wafer comprises at least one semiconductor wafer that has been polished immediately prior to said polishing of said semiconductor wafer having said uneven surface.

5. A method as claimed in claim 3, wherein said certain period of time is determined based on an average of polishing rates of a plurality of semiconductor wafers that have been polished immediately prior to said polishing of said semiconductor wafer having said uneven surface.

6. An apparatus for polishing and for determining an endpoint of polishing of a semiconductor wafer including unexposed wiring pattern portions covered by an exposed insulating layer having an uneven exposed surface, said apparatus comprising:

a polishing platen;

a top ring for pressing the uneven exposed surface of the semiconductor wafer against said polishing platen, while the semiconductor wafer and said platen are moved relative to each other, thereby polishing the surface;

a detector operable to detect a frictional force between the surface and said platen; and processing means, operably connected to said detector and operable in response to detection of the frictional force thereby, for determining a reference time as a time of a change in the detected frictional force representative of the uneven exposed surface having been polished to a flat surface, and for determining an endpoint of polishing of the semiconductor wafer as a certain period of time of continued polishing after said reference time at which a predetermined thickness portion of the exposed insulating layer remains covering the wiring pattern portions without the wiring pattern portions being exposed.

7. An apparatus as claimed in claim 6, wherein said detector comprises means for determining a change in current of a driving motor for rotating said top ring or said platen.

8. An apparatus as claimed in claim 6, wherein said processing means comprises means for varying said certain period of time based on an amount of polishing and a polishing time of at least one other previously polished semiconductor wafer.

9. An apparatus as claimed in claim 8, wherein said means is operable to determine said certain period of time based on said amount of polishing and said polishing time of at least one other semiconductor wafer that has been polished immediately prior to said polishing of the semiconductor wafer having the uneven surface.

10. An apparatus as claimed in claim 8, wherein said means is operable to determine said certain period of time based on an average of polishing rates of a plurality of semiconductor wafers that have been polished immediately prior to said polishing of the semiconductor wafer having the uneven surface.

* * * * *

UNITED STATES PATENT AND TRADEMARK OFFICE

CERTIFICATE OF CORRECTION

PATENT NO. : 5,830,041
DATED : November 3, 1998
INVENTOR(S) : Tamami Takahashi et al.

It is certified that error appears in the above-identified patent and that said Letters Patent is hereby corrected as shown below:

Title page,
Item [73], Assignee, add -- Kabushiki Kaisha Toshiba, Kanagawa-ken, Japan --.

Signed and Sealed this

Twenty-eighth Day of February, 2006

JON W. DUDAS
*Director of the United States Patent and Trademark Office*